US005603529A

United States Patent [19]

Breindel

[11] Patent Number: 5,603,529

[45] Date of Patent: Feb. 18, 1997

[54] COLOR BROCHURE WITH INTEGRAL RETURN MAILER AND METHOD OF MAKING IT

[76] Inventor: Harold Breindel, 75 Albertson Ave., Albertson, N.Y. 11507

[21] Appl. No.: 513,216

[22] Filed: Aug. 10, 1995

[51] Int. Cl.[6] ..... B42D 15/00

[52] U.S. Cl. ..... 283/56; 283/116; 229/92.1; 229/301; 493/188; 493/264

[58] Field of Search ..... 283/61, 62, 56, 283/99, 106, 115, 116, 67; 281/2, 5; 229/300, 301, 302, 75, 92, 92.1, 92.7; 40/124.1, 1, 584, 359; 493/187, 188, 243, 264, 267, 917

[56] References Cited

U.S. PATENT DOCUMENTS

| | | | |
|---|---|---|---|
| 2,910,222 | 10/1959 | Bermingham, Jr. et al. | 229/301 |
| 3,701,468 | 10/1972 | Steinhauser | 229/92.7 |
| 4,044,942 | 8/1977 | Sherwood | 229/92.1 |
| 4,668,211 | 5/1987 | Lubotta et al. | 493/188 |
| 4,865,247 | 9/1989 | Grabner | 229/92.1 |
| 5,290,225 | 3/1994 | Younger | 493/188 |
| 5,487,566 | 1/1996 | Hedge, Jr. | 283/56 |

FOREIGN PATENT DOCUMENTS

| | | | |
|---|---|---|---|
| 78659 | 10/1919 | Austria | 229/92.1 |
| 1507535 | 12/1967 | France | 229/75 |

*Primary Examiner*—David P. Bryant
*Attorney, Agent, or Firm*—Galgano & Burke

[57] ABSTRACT

A color brochure with integral return mailer includes a single piece of paper which is folded along three fold lines to define four panels and eight panel sides. One side of the piece of paper is imprinted in color and the other side is imprinted in black and white only. On the color side, the first two adjacent panel sides are printed as a full bleed double panel color display, the panel side immediately below the full bleed display is imprinted with a reply form which may also include color, and the last panel side on the color side is imprinted with the first page color display. On the black and white side, the first panel side is imprinted with a business reply prepaid postage and return address, the second panel side is printed with the back page display and the last two panel sides are left blank. When the blank panel sides are folded to face each other, an envelope pocket is created and the blank panel sides are sealed at their edges in a conventional way. After the envelope pocket is created, the front and back pages are located adjacent to each other. Prior to presentation to a customer, the full bleed display is folded on top of itself which locates the reply form adjacent to the prepaid postage and return address panel side. These panel sides are folded toward each other and the front and back pages are thus appropriately located.

18 Claims, 7 Drawing Sheets

46
42
HEADLINE
18b
text text text text text
44
18
17
16b
text text text text text

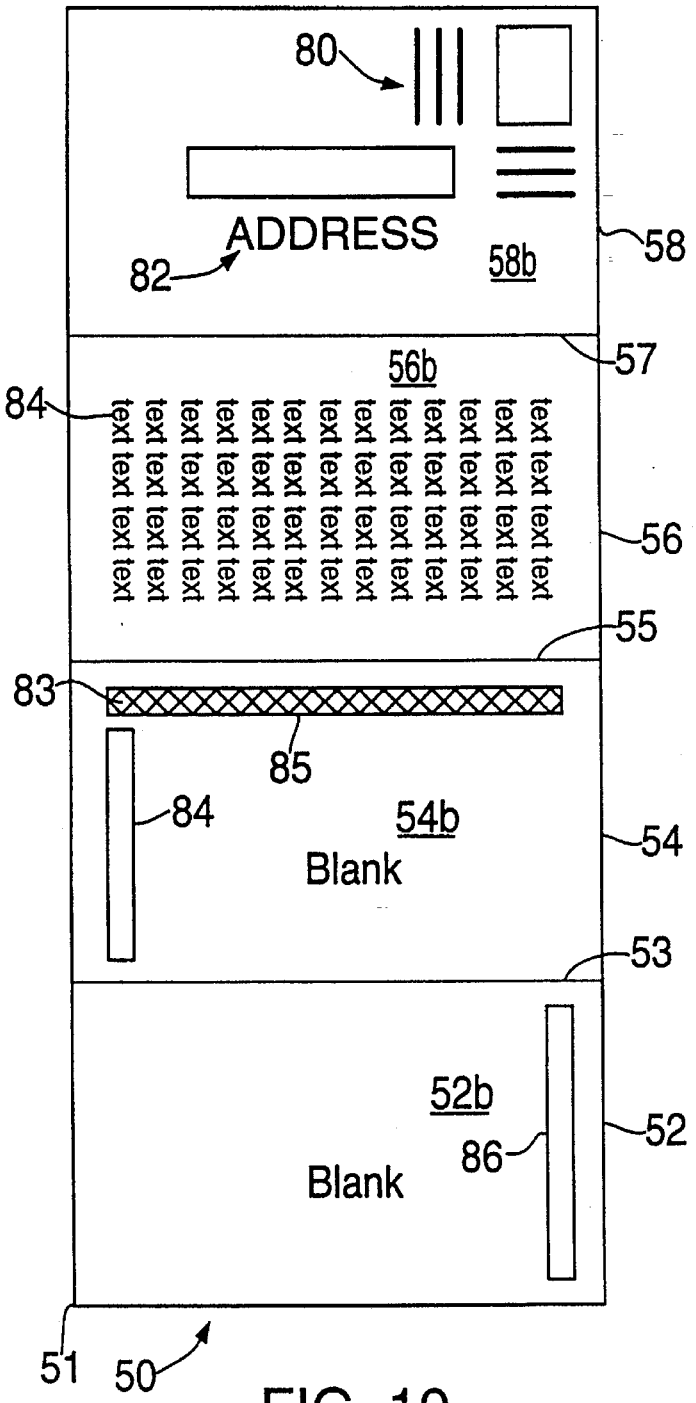
80
ADDRESS
82
58b
58
57
56b
84
text text text

COLOR BROCHURE WITH INTEGRAL RETURN MAILER AND METHOD OF MAKING IT

BACKGROUND OF THE INVENTION

1. Field of the Invention

The invention relates to the forming and printing of paper products. More particularly, the invention relates to a color paper brochure with an integral return mailer and a method for making it.

2. State of the Art

Products are often advertised in brochures which are distributed by direct mail or as inserts in magazines, newspapers, packages, card decks, or any other vehicle for the distribution of mail. It is known to provide a color product brochure with an integral return mailer for ordering the advertised product. Prior art FIGS. 1–8 illustrate how a typical color brochure with an integral return mailer is made. The brochure 10, shown in FIGS. 1–8, is composed of a rectangular piece of paper 11 which is divided into four panels 12, 14, 16, 18 by fold lines 13, 15 and perforations 17. Each panel has a first side 12*a*, 14*a*, 16*a*, 18*a* and a second side 12*b*, 14*b*, 16*b*, 18*b*, each of which represents a rectangular page upon which information may be printed. In order to provide a return mail envelope, the first sides 12*a* and 14*a* of panels 12 and 14 are left blank as seen in FIG. 1. The blank sides 12*a* and 14*a* are folded towards each other along fold line 13 as shown in FIG. 3. Adhesive strips 20, 22 are provided on one or both of the panel sides 12*a* and 14*a* as shown, for example, in FIG. 1 so that opposite edges of the panels can be sealed to form an envelope pocket 24 (seen best in FIGS. 3 and 4). The second side 12*b* of panel 12 is imprinted with order form information 26 and space 28 for the customer's address. Comparing FIGS. 2 and 4, it will be appreciated that the panel side 12*b* is preferably printed upside down so that it will read correctly after the panels 12, 14 are folded along line 13. Panel side 14*b* is imprinted with pre-paid postage 30 and the address 32 of the supplier of the advertised goods.

The remaining panel sides 16*a*, 16*b*, 18*a*, 18*b* are available for advertising material (text and graphics). As seen best in FIGS. 1 and 2, panel sides 16*a* and 18*a* are imprinted with a "full bleed" across the perforations 17 with text 34 and color graphics 36 describing and illustrating the product advertised. Headline text 38 is provided along the top of panel side 18*a* indicating the name and/or important features of the product. Panel sides 16*b* and 18*b* are treated as individual pages which will form the front page (18*b*) and back page (16*b*) of the brochure 10 when the panels are folded as described below. In particular, panel side 16*b* may contain text 40 describing the product and/or testimonials to the product. Panel side 18*b* may contain graphics 42, brief text 44, and headline text 46 briefly describing the product which is described in more detail on panel sides 16*a*, 18*a*.

Before presenting the brochure 10 to a potential customer, the brochure 10 is folded along line 15 as shown in FIG. 5 with panel side 12*b* facing panel side 16*a* and along perforations 17 so that panel side 18*a* faces panel side 14*b*. The brochure 10, as presented, has a front panel side 18*b* and a rear panel side 16*b*. The customer browses the brochure by unfolding the panels to see the full bleed double panel display on panel sides 16*a*, 18*a*. To use the envelope 24, the customer removes panel 18 by tearing along the perforations 17 and folds panel side 16*a* on top of panel side 12*b*, after filling out the order form printed on panel side 12*b*. As seen best in FIG. 4, the lower portion of panel side 12*b* is provided with a moisture-activated adhesive strip 48 which seals with the upper portion of panel side 16*a* to seal the envelope pocket 24. Although possible to place the strip 48 on the upper portion of panel side 16*a*, it is preferable to place it on panel side 12*b* so it does not interfere with the text 34 and graphics 36.

From the foregoing, it will be appreciated that in order to provide color graphics 36 and 42 on both the full bleed product display on panel sides 16*a*, 18*a* as well as on the front page panel 18*b*, it is necessary to print the paper 11 in color on both sides thereof. Moreover, it will also be appreciated that the perforations 17 may be considered a disadvantage of the brochure 10 in that panel 18 may be prematurely separated from the brochure and that panel 16 may be damaged or torn when the customer attempts to remove the panel 18.

SUMMARY OF THE INVENTION

It is therefore an object of the invention to provide a color brochure with an integral return mailer which is made from a folded piece of paper, has the appearance of being printed in color on both sides, but which is only printed in color on one side.

It is also an object of the invention to provide a color brochure with an integral return mailer which is made from a folded piece of paper and which does not contain perforations.

In accord with these objects which will be discussed in detail below, the color brochure with integral return mailer of the present invention includes a single piece of paper which is folded along three fold lines to define four panels and eight panel sides. One side of the piece of paper is imprinted in color and the other side is imprinted in black and white only. On the color side, the last panel side on the color side is imprinted with a first (front) page color display. On the black and white side, the first panel side is imprinted with a business reply prepaid postage and return address, the second panel is printed with a last (back) page display, and the last two panel sides are left substantially blank. When the blank panel sides are folded to face each other, an envelope pocket is created and the blank panel sides are sealed at their edges in a conventional way. After the envelope pocket is created, the front and back pages are located adjacent to each other. Prior to presentation to a customer, the first two panels on the color side are folded on top of each other which locates the reply form adjacent to the prepaid postage and return address panel side. These panel sides are folded toward each other and the front and back pages are thus appropriately located.

According to a presently preferred embodiment of the invention, the last panel, one side of which becomes the front page, is slightly shorter than the other panels so that when the envelope pocket is formed, an upper portion of the first blank panel is exposed. The exposed portion of the first blank panel is provided with a strip of moisture activated adhesive beneath which a brief instructional message is preferably imprinted on the otherwise blank panel side. The reply form preferably includes a color graphic display and instructions for folding the return mailer to seal the envelope pocket. The return mailer is used by refolding the panels so that the first panel side of the color side overlies the last panel of the color side. The upper portion of the first color panel side therefore is sealed with the strip of moisture activated adhesive. The upper portion of the first color panel side is preferably provided with a brief instructional message which corresponds to the instructional message on the exposed portion of the first (otherwise) blank panel. Additional objects and advantages of the invention will become apparent to those skilled in the art upon reference to the detailed description taken in conjunction with the provided figures.

BRIEF DESCRIPTION OF THE DRAWINGS

FIG. 10 is a plan view of the other side of the brochure of FIG. 9 before folding and gluing;

FIG. 11 is a schematic side elevation view of the brochure of FIGS. 9 and 10 during a first folding step;

DETAILED DESCRIPTION OF THE PREFERRED EMBODIMENTS

Figure 1:
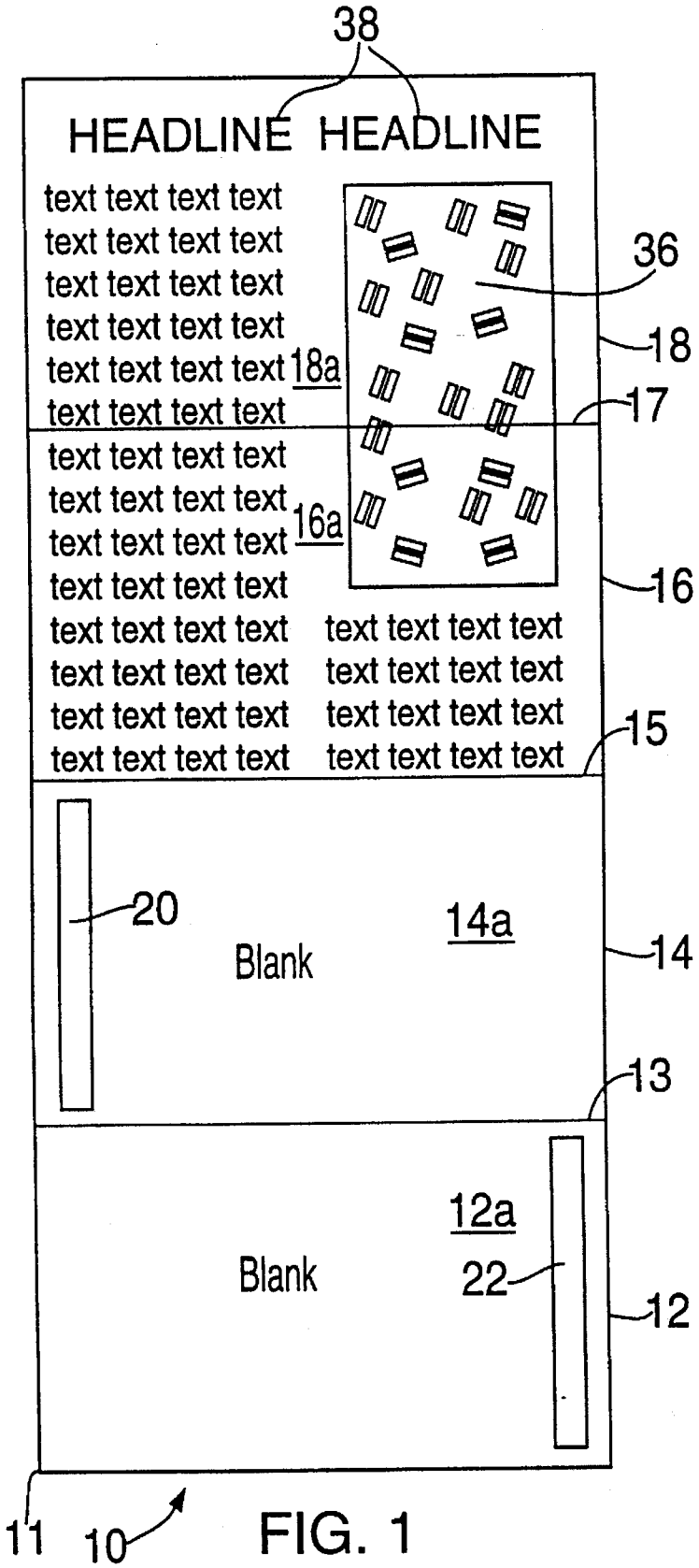
FIG. 1 PRIOR ART
FIG. 1 is a plan view of one side of a prior art brochure with integral return mailer prior to folding and gluing.
Figure 2:
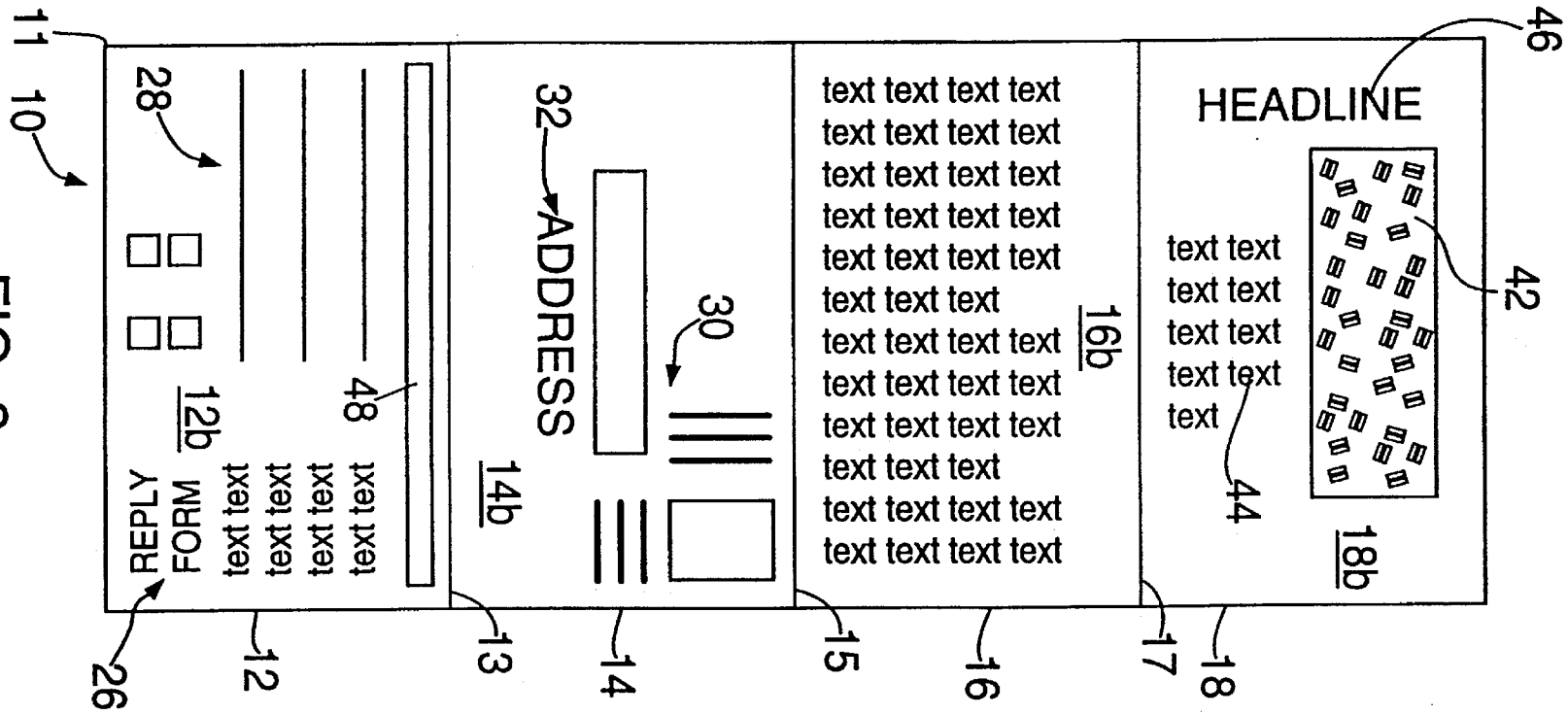
FIG. 2 is a plan view of the other side of the prior art brochure with integral return mailer prior to folding and gluing.
Figures 3, 4, 5, 6, 7:
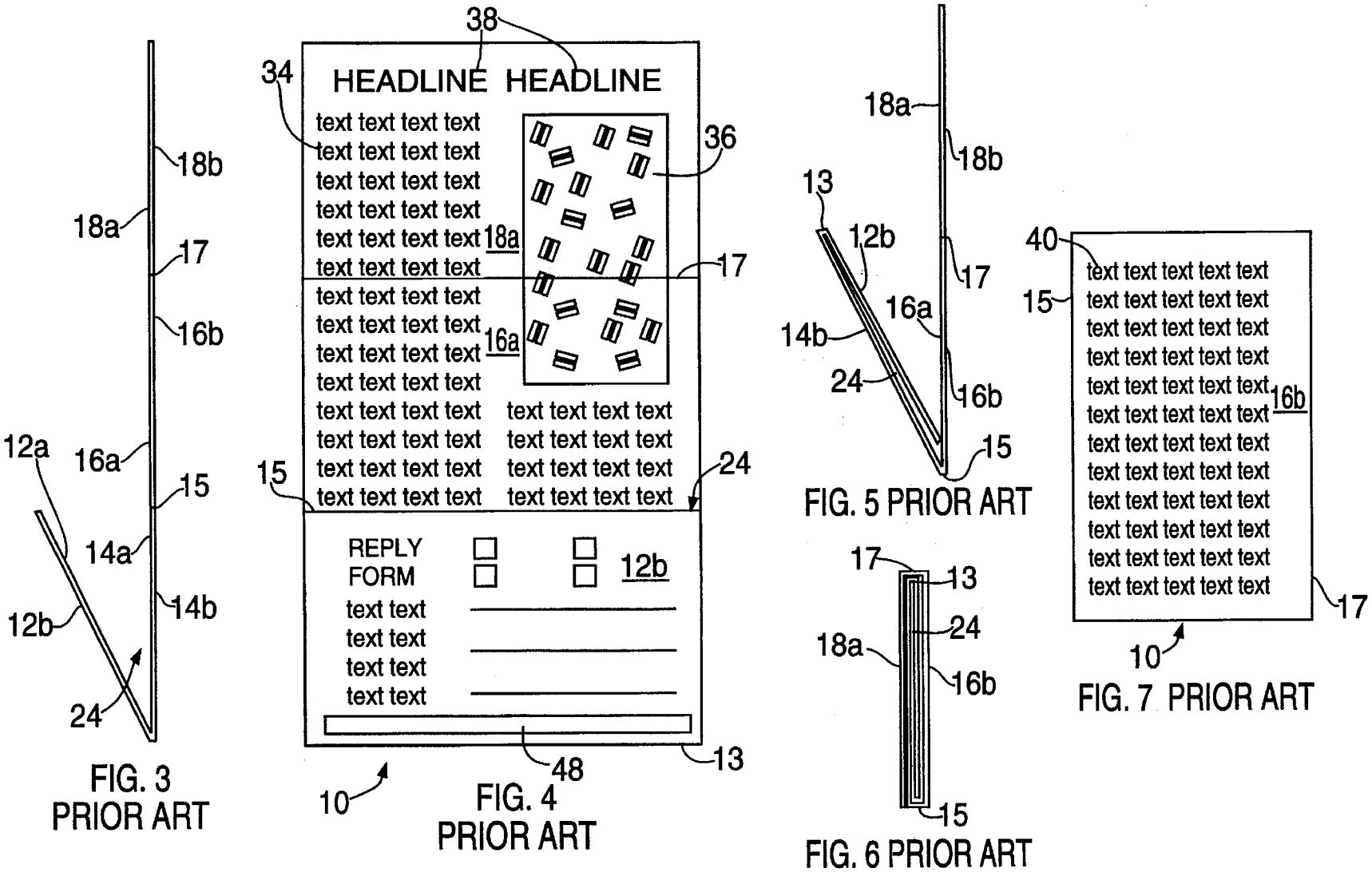
FIG. 3 PRIOR ART
FIG. 4 PRIOR ART
FIG. 5 PRIOR ART
FIG. 6 PRIOR ART
FIG. 7 PRIOR ART
FIG. 3 is a schematic side elevation view of the prior art brochure during a first folding step.
FIG. 4 is a plan view of one side of the prior art brochure with integral return mailer after the first step of folding and gluing.
FIG. 5 is a view similar to FIG. 3 during a second folding step.
FIG. 6 is a view similar to FIGS. 3 and 5 after a third folding step.
FIG. 7 is a plan view of one side of the prior art brochure as presented to a customer.
Figure 8:
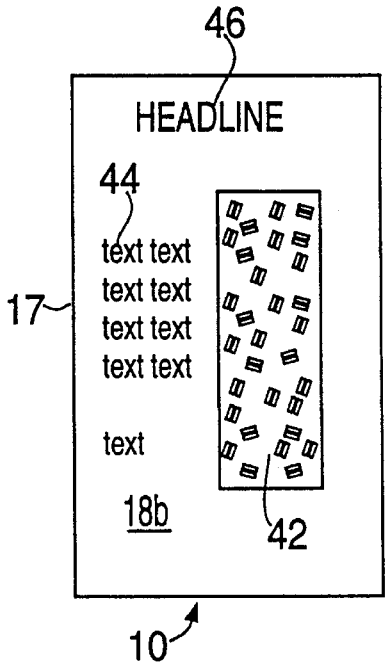
FIG. 8 PRIOR ART
FIG. 8 is a plan view of the other side of the prior art brochure as presented to a customer.
Figure 9:
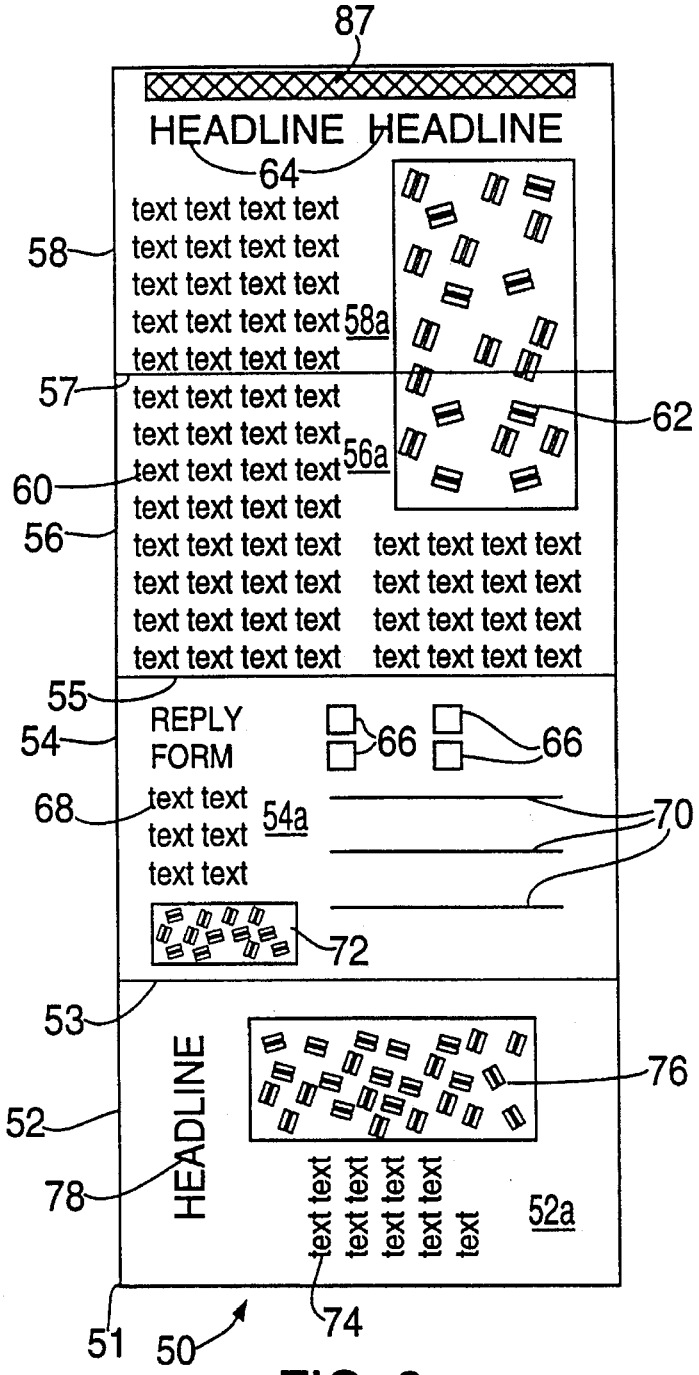
FIG. 9 is a plan view of one side of a brochure according to the invention before folding and gluing.

Referring now to FIGS. 9 and 10, a color brochure with integral return mailer 50, according to the invention includes a single piece of paper 51 which is folded along three fold lines 53, 55, 57 to define four panels 52, 54, 56, 58. As referred to herein below, panel 58 is a first end panel, panel 56 is a first interior panel, panel 54 is a second interior panel, and panel 52 is a second end panel. The four panels define eight panel sides 52*a*, 54*a*, 56*a*, 58*a* (FIG. 9) and 52*b*, 54*b*, 56*b*, 58*b* (FIG. 10). According to the invention, one side of the piece of paper 51 is imprinted in color and the other side is imprinted in black and white only. For example, as shown in FIG. 9, the first two adjacent panel sides 58*a*, 56*a* are printed as a full bleed double panel color display, including text 60, graphics 62, and headline text 64. The panel side 54*a* immediately below the full bleed display is imprinted with a reply form including selection check boxes 66, text 68, lines 70 for the customer's address, and a color graphic 72 which may illustrate how to use the return mailer 50. The last panel side 52*a* on the color side is imprinted with the first page color display of the brochure including text 74, color graphics 76, and headline text 78. On the black and white side, as shown in FIG. 10, the first panel side 58*b* is imprinted with a business replay prepaid postage 80 and return address 82. The second panel side 56*b* is printed with the back page display which is typically text 84. The last two panel sides 54*b*, 52*b* are left substantially blank.

According to a presently preferred embodiment of the invention, the last panel 52, one side (52*a*) of which becomes the front page, is slightly shorter than the other panels. An upper portion of the substantially blank panel 54*b* is preferably provided with a strip of moisture activated adhesive 83 (or other envelope sealing means such as a peel and stick strip) and beneath the strip 83, a brief instructional message or indicia 85 is preferably provided. The first color panel side 58*a* is preferably provided with a brief instructional message or indicia 87 which corresponds to the message or indicia 85 on the upper portion of the substantially blank panel 54*b*.

Figures 12, 13, 14, 15:
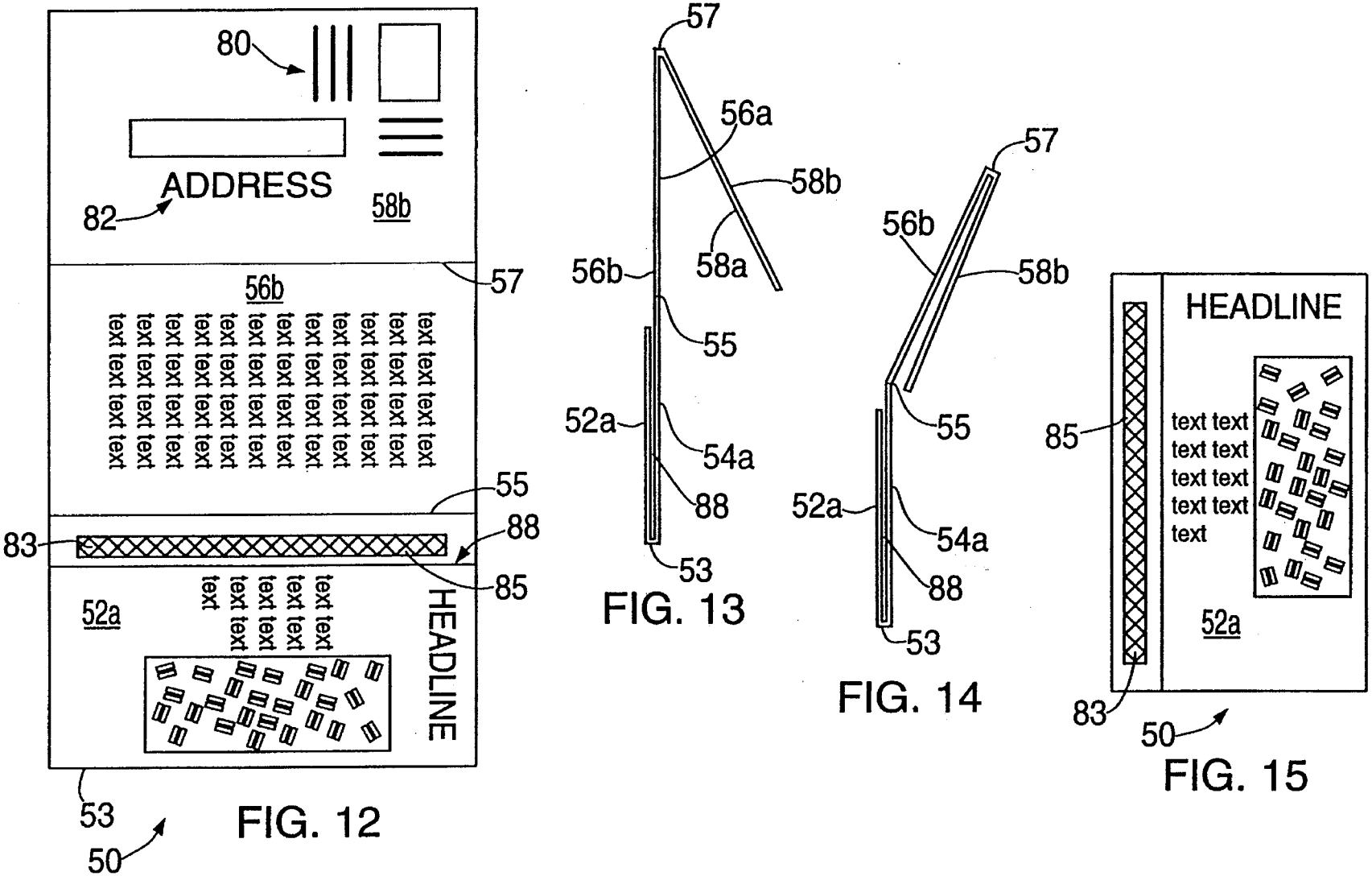
FIG. 12 is a plan view of one side of the brochure of FIGS. 9–11 after the first step of folding and gluing.
FIG. 13 is a view similar to FIG. 11 during a second folding step.
FIG. 14 is a view similar to FIGS. 11 and 13 during a third folding step.
FIG. 15 is a plan view of one side of the brochure of FIGS. 9–14 as presented to a customer.

Referring now to FIGS. 10–12, the blank panel sides 52*b*, 54*b* are folded to face each other and are sealed at their edges with glue strips 84, 86 (FIG. 10) to create an envelope pocket 88. After the envelope pocket is created, the panel side 52*a* (front page) and the panel side 56*b* (back page) are located adjacent to each other (FIG. 12). Since the panel 52 is shorter than the panel 54, the upper portion of panel side 54*b* is exposed exposing the adhesive strip 83 and the indicia 85 as shown in FIG. 12.

Figure 16:
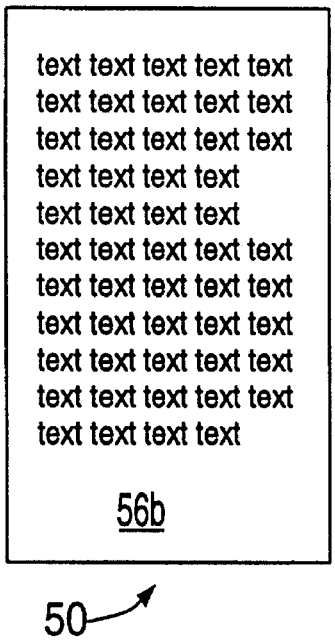
FIG. 16 is a plan view of the other side of the brochure of FIGS. 9–15 as presented to a customer.

Referring now to FIGS. 12 through 16, the brochure 50 is folded along lines 55 and 57 prior to presentation to a customer. According to the invention, the panel sides 58*a*, 56*a* (see also FIG. 9) containing the full bleed display are folded at line 57 to face each other as shown in FIG. 13. This locates the panel 58*b* (containing the return postage 80 and address 82) adjacent the panel 54*a* (containing the reply form). These panel sides 58*b* and 54*a* are folded toward each other along line 55. The resulting brochure 50 displays panel side 52*a* as a front side (page) and panel side 56*b* as a back side (page) as shown in FIGS. 15 and 16.

Turning now to FIGS. 9 and 12, when the brochure 50 is unfolded by a customer, one side of the brochure is presented as seen in FIG. 12 and the other side is presented as seen in the first three panel sides 58*a*, 56*a*, 54*a* in FIG. 9. It will be appreciated that the first three panel sides 58*a*, 56*a*, 54*a* contain color printing and that the panel side 52*a* also contains color printing. The brochure therefore appears to have color printing on both sides even though it was printed in color on one side only. As mentioned above, one or more of the color graphic 72, and the indicia 85, 87 includes instructions for folding the brochure into a return mailer.

Figure 18:
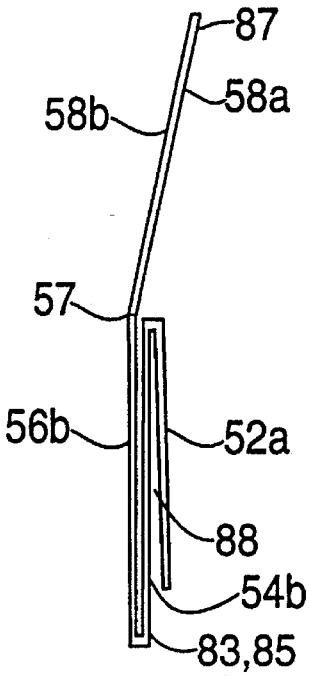
FIG. 18 is a view similar to FIG. 17 showing a second folding step for sealing the return mailer.
Figure 17:
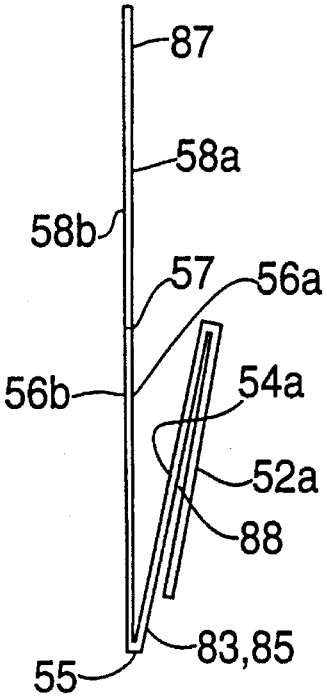
FIG. 17 is a view similar to FIG. 13 showing a first folding step for sealing the return mailer.
Figure 19:
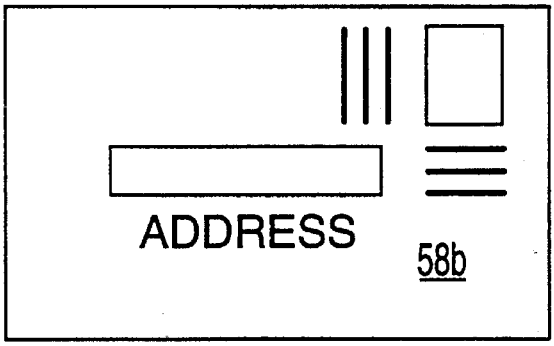
FIG. 19 is a plan view of one side of the return mailer according to the invention.
Figure 20:
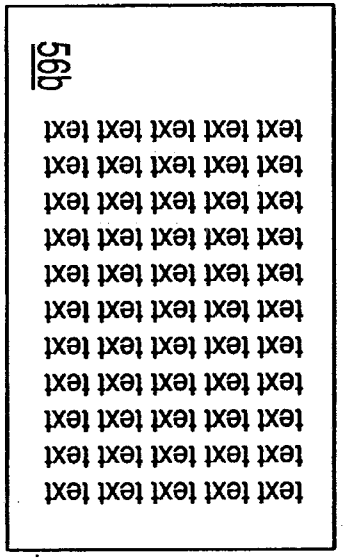
FIG. 20 is a plan view of the other side of the return mailer according to the invention.

Turning now to FIGS. 12 and 17–20, the return mailer is used by refolding the panels from the unfolded state shown in FIG. 12. Prior to folding, however, the customer fills out the reply form on panel 54*a* (FIG. 12). The brochure 50 is then folded first at line 55 so that the panel side 54*a* faces the panel side 56*a* as shown in FIG. 17. This places panel side 58*a* adjacent to panel side 52*a*. Prior to folding along line 57, the customer inserts a check, coupon, or the like in the envelope pocket 88 and moistens the adhesive strip 83. The brochure is then folded along line 57 so that the panel side 58*a* faces the panel side 52*a* as shown in FIG. 18. It will be appreciated that after folding along line 57, the indicia 87 on panel side 58*a* is aligned with and overlies the indicia 85 and the adhesive strip 83 on the exposed portion of the panel side 54*b*. The resulting return mailer presents panel side 58*b* on one side and panel side 56*b* on the other side as shown in FIGS. 19 and 20.

From the foregoing example, it will be appreciated that the method of making the color brochure according to the invention involves the location of the return address and the folding of an end color panel onto the black and white side. More specifically, after a cut sheet of paper is obtained, it is printed on one side in black and white only and on the other side with color. The first end panel on the black and white side should contain the return address and the second end panel on the color side should be folded onto the black and white side to form the envelope pocket. The other folding operations prior to presentment to a customer may be varied from what is disclosed above, but it is preferable that the folds hide the return address panel so that a more informative panel may be displayed. While it is not essential that the second end panel on the color side be printed with first page or cover page information, it is preferable to do if this will be the only color page visible after folding prior to presentment. Those skilled in the art will appreciate that the panels can be "Z-folded" with panel 52*a* and panel 58*a* exposed for presentment to a customer. Depending on the layout on panels 58*a* and 56*a*, this may be advantageous. However, if panels 58*a* and 56*a* are used for a two panel full bleed layout as shown above, a Z-fold may be undesirable. It will also be appreciated that the printing step of the method may be performed on a continuous roll of paper prior to cutting and folding.

There has been described and illustrated herein a color brochure with an integral return mailer and a method for making it. While particular embodiments of the invention have been described, it is not intended that the invention be limited thereto, as it is intended that the invention be as broad in scope as the art will allow and that the specification be read likewise. Thus, while particular locations for text and graphics have been disclosed, it will be appreciated that other locations could be utilized. Also, while a full bleed display across two panel sides have been shown, it will be recognized that other types of displays and layouts could be used with similar results obtained. Moreover, while particular configurations have been disclosed in reference to the layout of the return address and prepaid postage and the reply form, it will be appreciated that other configurations could be used as well. Furthermore, while the black and white printed side of the brochure has been disclosed as having substantially text only, it will be understood that black and white graphics can achieve the same or similar function as disclosed herein. It will therefore be appreciated by those skilled in the art that yet other modifications could be made to the provided invention without deviating from its spirit and scope as so claimed.

I claim:

1. A color brochure with an integral return mailer, comprising:

a single sheet of paper having a first side and a second side;

said first side being printed in color and said second side being printed in black and white only;

said sheet being folded along three fold lines to define a first end panel, a second end panel, a first interior panel adjacent to said first end panel, and a second interior panel adjacent to said second end panel;

said first end panel of said sheet being printed on said second side with a return address; and said second end panel being folded onto said second interior panel on said second side of said sheet and being glued onto said second side to form an envelope pocket.

2. A color brochure according to claim 1, wherein:

said second end panel is shorter than said first end panel.

3. A color brochure according to claim 2, wherein:

said first end panel, said first interior panel, and said second interior panel are substantially the same size.

4. A color brochure according to claim 3, wherein:

a portion of said second interior panel adjacent to said first interior panel on said second side is provided with an envelope sealing strip.

5. A color brochure according to claim 4, wherein:

said envelope sealing strip is uncovered by said second end panel.

6. A color brochure according to claim 5, wherein:

said portion of said second interior panel is provided with first indicia indicating the location of said sealing strip.

7. A color brochure according to claim 6, wherein:

a portion of said first end panel on said first side is provided with second indicia corresponding to said first indicia.

8. A color brochure according to claim 7, wherein:

said envelope pocket is sealed by folding said first interior panel and said first end panel so that said second indicia overlies said first indicia.

9. A color brochure according to claim 5, wherein:

said first end panel is folded onto said first interior panel on said first side and said first interior panel is folded onto said second interior panel on said first side.

10. A method of making a color brochure with an integral return mailer, comprising:

obtaining a sheet of paper having a first side and a second side;

printing said first side with color inks;

printing said second side with black ink only;

folding said sheet being along three fold lines to define a first end panel, a second end panel, a first interior panel adjacent to said first end panel, and a second interior panel adjacent to said second end panel, wherein said first end panel of said sheet is printed on said second side with a return address;

folding said second end panel onto said second interior panel on said second side of said sheet; and gluing said second end panel onto said second side to form an envelope pocket.

11. A method according to claim 10, wherein:

said second end panel is shorter than said first end panel.

12. A method according to claim 11, wherein:

said first end panel, said first interior panel, and said second interior panel are substantially the same size.

13. A method according to claim 12, further comprising:

providing a portion of said second interior panel adjacent to said first interior panel on said second side with an envelope sealing strip.

14. A method according to claim 13, wherein:

said envelope sealing strip is uncovered by said second end panel.

15. A method according to claim 14, further comprising:

providing said portion of said second interior panel with first indicia indicating the location of said sealing strip.

16. A method according to claim 15, further comprising:

providing a portion of said first end panel on said first side with second indicia corresponding to said first indicia.

17. A method according to claim 16, further comprising:

folding said first interior panel and said first end panel so that said second indicia overlies said first indicia.

18. A method according to claim 13, further comprising:

folding said first end panel onto said first interior panel on said first side; and folding said first interior panel onto said second interior panel on said first side.

* * * * *